United States Patent [19]

Koot

[11] 4,406,335

[45] Sep. 27, 1983

[54] SPECIAL CIRCULATION SUB

[76] Inventor: Nick Koot, Vlaskamp 104, The Hague, Netherlands

[21] Appl. No.: 313,116

[22] Filed: Oct. 20, 1981

[30] Foreign Application Priority Data

Oct. 30, 1980 [NL] Netherlands ..... 8005960

[51] Int. Cl.[3] ..... E21B 17/00; E21B 21/10; E21B 34/10

[52] U.S. Cl. ..... 175/317; 166/318; 166/319; 175/243

[58] Field of Search ..... 166/318, 319, 321, 323; 175/237, 243, 317; 137/118, 119

[56] References Cited

U.S. PATENT DOCUMENTS

| | | | |
|---|---|---|---|
| 2,330,155 | 9/1943 | Stokes | 175/237 X |
| 2,394,759 | 2/1946 | Edwards | 166/318 X |
| 2,737,244 | 3/1956 | Baker et al. | 166/318 X |
| 3,675,718 | 7/1972 | Kanady | 166/319 X |
| 3,915,245 | 10/1975 | Tuccillo | 175/237 |
| 4,220,206 | 9/1980 | Van Winkle | 166/318 |

*Primary Examiner*—Ramon S. Britts
*Assistant Examiner*—Joseph Falk
*Attorney, Agent, or Firm*—Ladas & Parry

[57] ABSTRACT

Special circulation subs mostly consist of an outer barrel which is provided in a cross-sectional plane with three circulation ports, which ports are closed during normal operation of the sub by means of a movable sleeve. The movement of such a sleeve is operated by steel or hard rubber balls which are pumped down the drill string.

In many cases it is desirable to be able not only to open the sub, but also to close it again. This is achieved by providing a spring loaded inner sleeve. That inner sleeve has a groove at its outer periphery to receive a plurality, preferably three balls which are adapted to cooperate via openings in the sleeve with two grooves in the outer barrel. Closing of the sub can be caused by a return sleeve, also controlled by a plurality of balls and a spring, located underneath the sleeve.

A special embodiment is characterized by a helical groove in the inner surface of a port sleeve.

6 Claims, 9 Drawing Figures

SPECIAL CIRCULATION SUB

Figure 1:
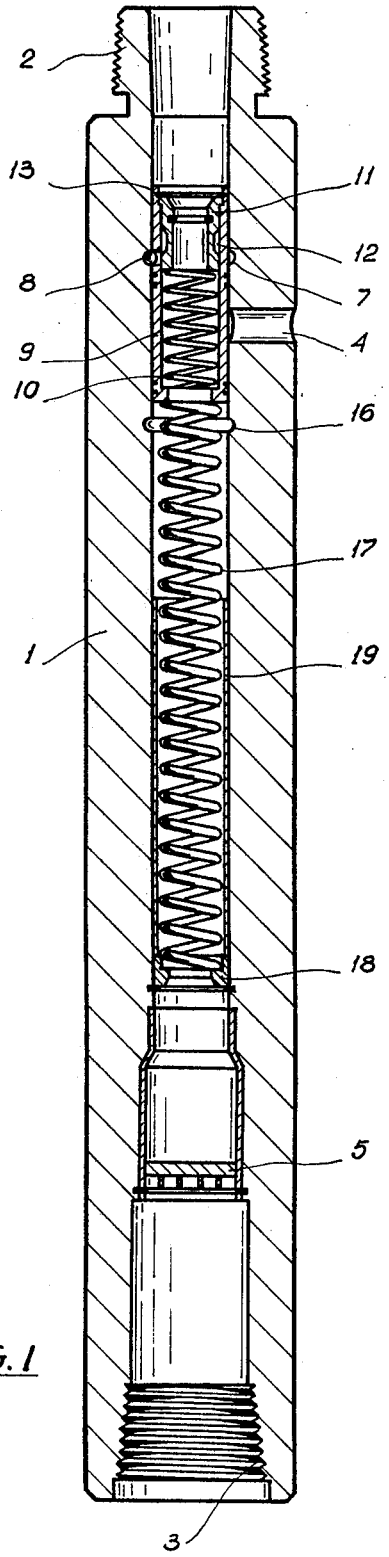

The present invention relates to a special circulation sub, generally consisting of an outer barrel which is provided at its upper end with API tool joint thread so as to be adapted to be connected to the last joint of a drill string, and provided at its lower end with API tool joint thread so as to be connected to a drill bit, whereby in a cross-sectional plane of the outer barrel a number, preferably three, of equally and mutually angularly spaced circulation ports is provided, which ports are closed during normal operation of the sub by means of a sleeve, movable in the outer barrel.

With the continued advancement in the techniques of oilwell-drilling and the intensified exploitation of both old and new fields, onshore and off shore, the wells are getting deeper and more complex, creating a demand for simple trouble-free tools that will obviate the need to remove and install the drill string every moment. These tools have to operate under all drilling-conditions in shallow and deep wells.

To illustrate the features of the special circulation sub, a few common operation problems are summed-up below:

- Setting of a cement-plug in open-hole or inside the casing and being able to "reverse-out" to remove the cement out of the drill-string.
- Setting 18 to 21 pounds per gallon barite-plugs or setting gunk-plugs in so-called lost circulation section in open hole. Barite is a trademark of a weight material to aggravate the mud which serves to plaster the wall of the well. A plug is an amount of weighted mud containing relatively coarse pieces, which often plug the bit.
- Circulating lost circulation materials (such as mica), which often plugs the bit because some of the flakes or materials are too coarse anyway.
- In case of a "plugged" bit, circulation in the well has to be re-established without the need to remove and install the drill string because this is a time consuming job and causes much loss of mud.
- During inflowing gas from a section in the formation it should be possible to set a cement-plug to control the well and to prevent a blow out!

The protection against a blow out is a safety factor of importance during drilling.

Consideration should also be given to the offshore-drilling operation in deep water (over 600 ft.). Circulating a "kick" out through a long choke line would create a considerably high pressure and the danger of damages to the choke line and high pressure hose lines due to shock-waves, If the circulation-sub is opened and the "kick" is circulated out through the drill string and the choke line the pressure on choke line is reduced. Then also less pressure is exerted on the formation and less damage of the wall-cake is one of the results. Another advantage: no bursting of casing due to high formation pressure.

The above signalized problems can be solved according to the invention by using the feature that the sleeve is displaceable in the direction of the center line of the sub, because within the sleeve a spring loaded inner sleeve is provided, said inner sleeve having a groove at its outer periphery to receive a plurality, preferably three balls, which are adapted to cooperate via openings in the sleeve with two grooves in the outer barrel.

Preferably the sleeve is adapted to be returned to the closed position of the sub due to the presence of a return sleeve, also controlled by a plurality of balls and a spring, which is arranged underneath the sleeve.

An embodiment is characterized in that the sleeve is provided with ports, corresponding to the circulation ports, and that it is rotatable about the center line of the sub because a protrusion at the outer circumference of a forced rectilinearly moving driving sleeve is in engagement with a helical groove in the inner surface of the port sleeve.

In the lower end of most embodiments a grid has to be provided to receive the rubber balls with which the inner sleeve is loaded.

Figure 2:
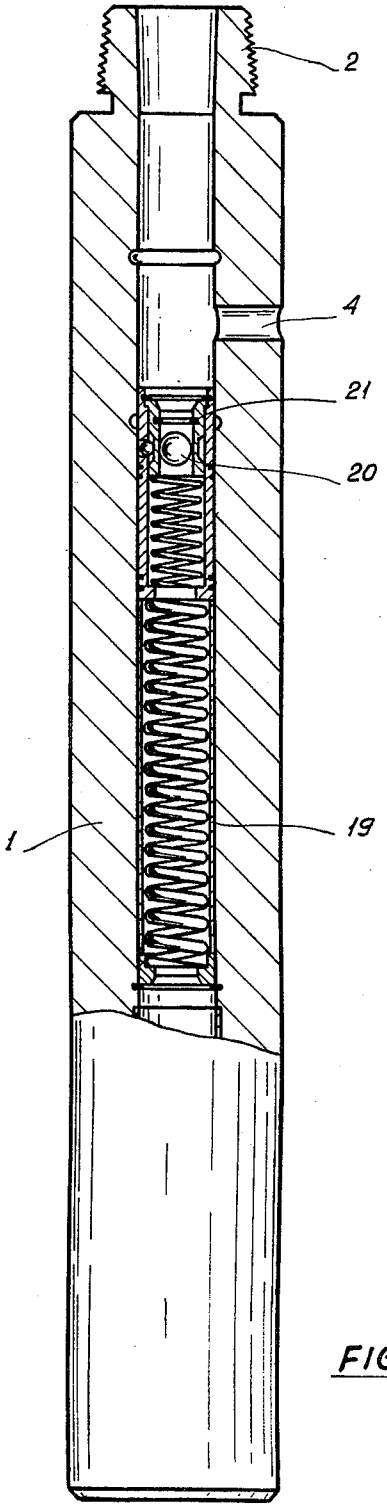
Figure 3:
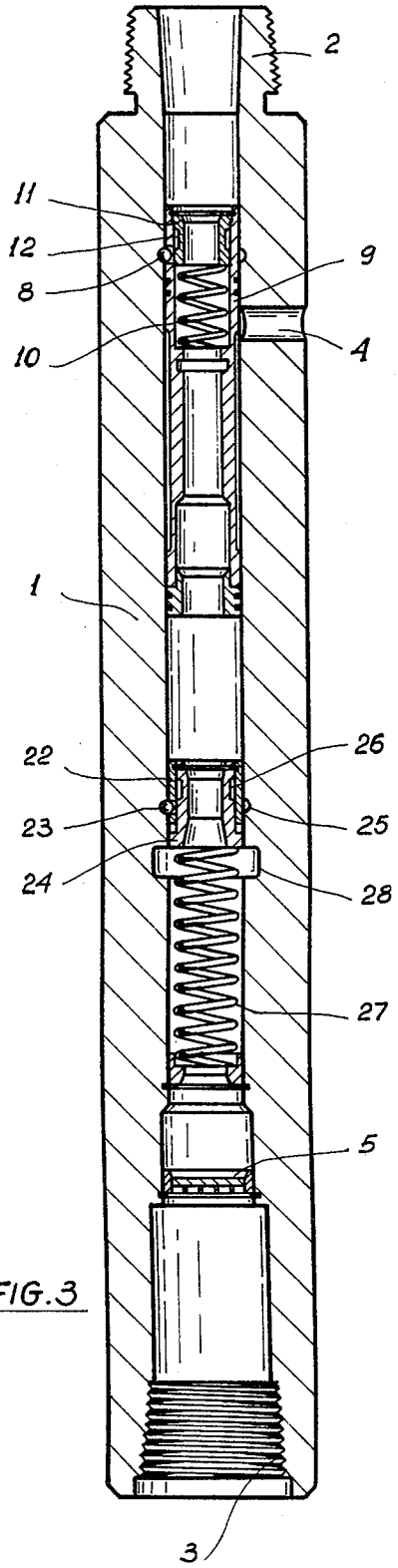
Figure 4:
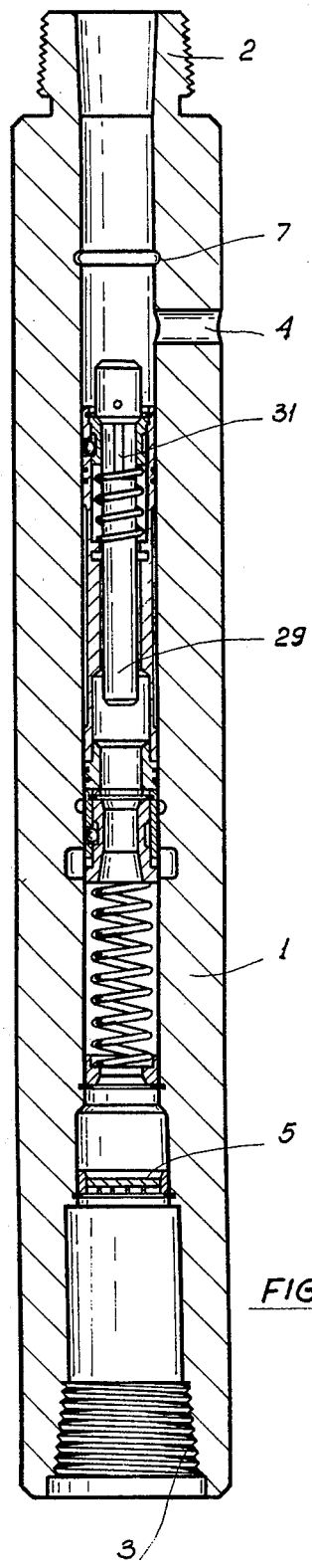
Figure 5:
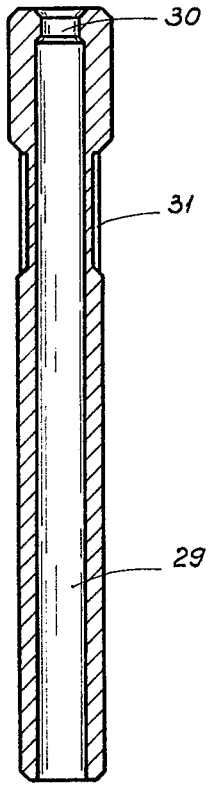
Figure 6:
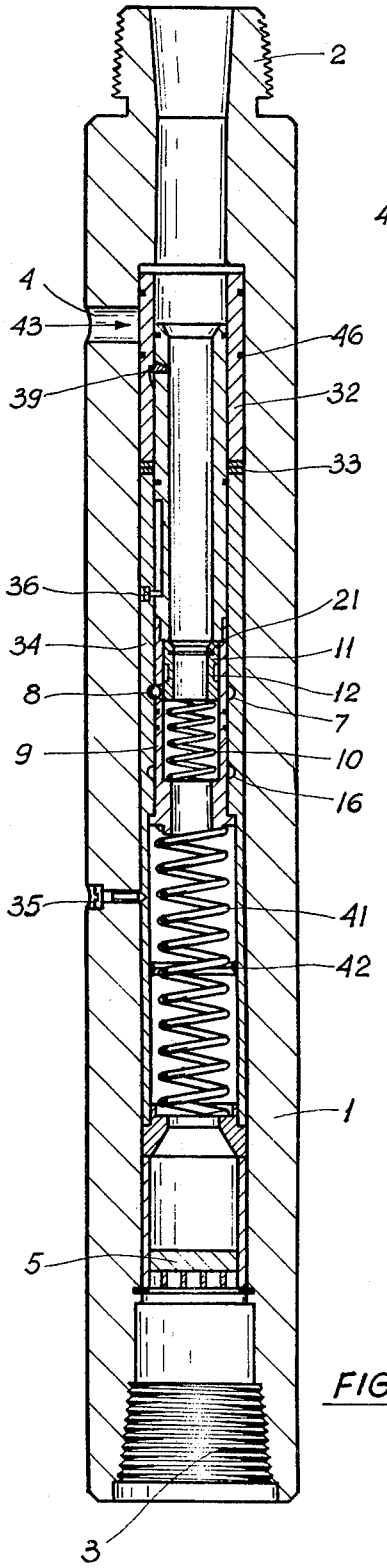
Figure 7:
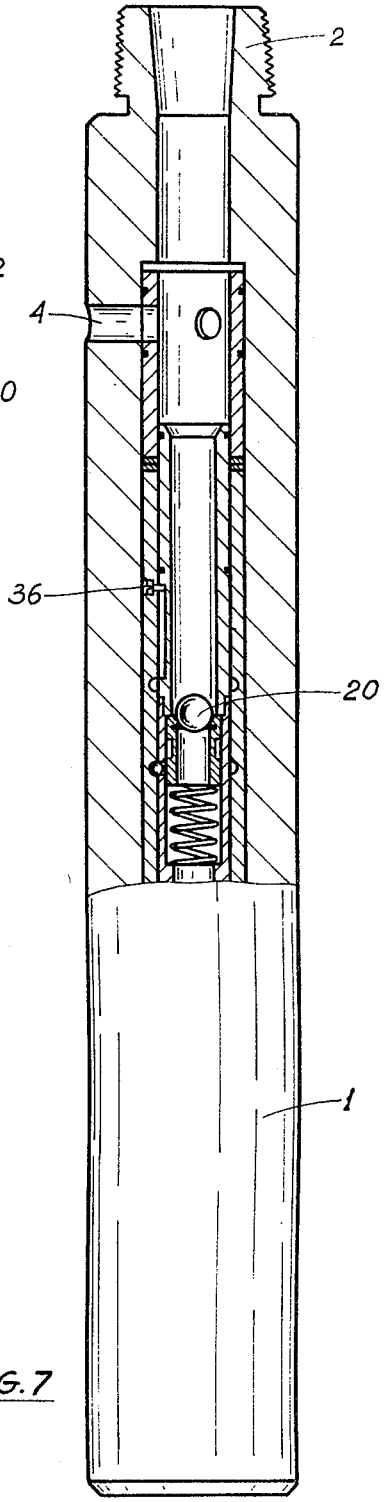

The invention will be further explained hereinafter on the basis of the drawing, in which by way of example a number of embodiments of a sub according to the invention is illustrated. In the drawing is shown by:

FIG. 1 a longitudinal section through a first embodiment of a sub, which sub is illustrated in the closed position with a rectilinearly movable sleeve which can be both opened and closed by using balls, FIG. 2 the same as in FIG. 1 but now in the opened position, FIG. 3 a longitudinal section through a second embodiment of a sub with a rectilinearly movable sleeve, said sub being illustrated in the closed position and which can be opened by using a mandrel, FIG. 4 shows the same as in FIG. 3, but now in the opened position, FIG. 5 in a larger scale a longitudinal section through the mandrel of FIG. 4, FIG. 6 a longitudinal section through an embodiment of a sub with a rotating sleeve, which sub is illustrated in the closed position, FIG. 7 the same as in FIG. 6 but now in the opened position.

Figure 8:
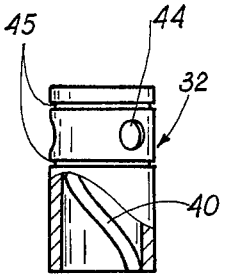

FIG. 8 a view of the port sleeve of the sub of FIGS. 6 and 7, and

Figure 9:
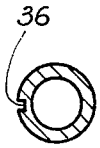

FIG. 9 a cross-section of the inner sleeve of the sub of FIGS. 6 and 7.

All subs as illustrated in the drawing, consist of an outer barrel 1 which is provided at its upper respectively lower end with a API-tool joint thread 2 respectively 3. Said API-tool joint thread means are generally known in oil drilling techniques to secure the tubings and the so-called drill bit to each other. The invented subs are all designed to be positioned between the lower joint and the drill bit. With respect to the dimensions one should think of lengths up to a magnitude of 2 meters and of external diameters up to a magnitude of 20 cm.

The outer barrels of all illustrated embodiments are furthermore provided with a plurality, preferably three, of equally and mutually angularly spaced circulation ports 4, arranged in a common cross-sectional plane of the outer barrel, which cross-sectional plane is located in the section of the length of the outer barrel 1, adjacent the stub 2, and furthermore being provided with a grid 5 which is relatively close to the upper end of the conical internal screw thread 3. That grid 5 is only visible in FIGS. 1 and 6 and serves to prevent the hard rubber balls or steel balls which are used to open and/or close the circulation ports, from reaching the drill bit and plugging off the circulation nozzles of the bit.

Above the grid 5 the inner circumference of the outer barrel may be somewhat widened; for that space should facilitate the collection of a plurality of rubber balls without hampering leaving sufficient area for circulation while not raising the pump pressure.

Circulation sub for use with rubber or steel balls

The inner surface of the outer barrel 1 is provided with a circular groove 7 which, in its closed position, is adapted to receive steel balls 8, which balls are present in the openings of a sleeve 9, in which sleeve 9 against the force of a helical spring 10 an inner sleeve 11 is movable which is provided at its outer circumference with a groove 12 to receive the steel balls 8.

The starting position should be imagined as being the one in which the upper leading plane of the inner sleeve 11 contacts a restriction ring 13 which is arranged in the sleeve 9 not to let the inner sleeve 11 escape. The ball 8 is located in the groove 7 then. When a ball 20 abuts against the leading plane of the inner sleeve 11, it will move same downwardly against the influence of the spring 10 and the balls may arrive in the groove 12, after which the whole system may descend until the balls 8 are received in the groove 16. The circulation ports 4 are open then.

First the circulation pressure of the drill string will rise and then descend to indicate that the circulation openings have opened. The balls 8, present in the openings of the sleeve 9, are made of steel and have a diameter of approximately ½ inch and alternately protrude more or less halfway into the groove 7 of the outer barrel 1, the groove 12 in the undercut section on the outside of the inner sleeve 11 respectively.

As further components are seen: a compression spring 17 which is placed between the sleeve 9 and a seat 18, and a stop sleeve 19, with which the sleeve 9 is in contact when a rubber ball 20 is forced through the inner sleeve 11, which condition is illustrated in FIG. 2. The inner sleeve 11 may have a groove in its inner circumferential plane near the upper end thereof, to receive a springwire-formed retaining ring 21 with an interior diameter which is somewhat smaller than the diameter of the rubber ball 20. If, however, the depth of the pertaining groove is at least equal to the thickness of the retaining ring, the latter can be forced therein completely.

To "open" the special circulation sub the steel or rubber ball 20 is pumped down in the drill string with good rate of pumping. As seen as the ball hits the retaining-ring 21, a pressure rise will be noted for a short period, the ball-locking device is opened and the inner sleeve is forced down compressing the spring 17 with a good rate of pump strokes. As soon as the pressure drops, it initiates, that the sleeve 9 has uncovered the three circulating ports 4, in about a minute the pump is slowly stopped. The sleeve 9 has landed on the stop-sleeve 19, as can be noticed in FIG. 2, the balls 8 are a little below the locking groove 16 of the body. Hereafter one has to reduce pump-pressure slowly to zero psi, then the compression spring 27 will lift inner sleeve 11 during decrease in pump delivery whereby the three balls 8 are also pushed into the groove by the force of spring 10. Thereafter one can operate with the same pressure of pump(s) as during drilling with closed circulating-ports. However if ports are open pressure should be considerable lower because the total area of the circulation ports is much larger than the total area of the bit nozzles.

The steel or rubber ball 20 which has been pumped down to unlock has been pumped-out to the screen 5 when the sleeve 9 has come to a deadstop and the impact force of the mud-column has been more than sufficient force to force the rubber ball through the retaining ring 21. Weight and viscosity of the drilling-mud making, however, a difference.

The screen 5 collects all lowered rubber balls so that obstruction of the (not-illustrated) nozzles of the drill bit is prevented.

Circulation sub for use with dropping-sleeve

As is the case in the preceding embodiment, in the embodiment of FIGS. 3–5 are present a groove 7, a set of steel balls 8 in a sleeve 9, a helical spring 10, and an inner sleeve 11 with a groove 12.

As additional means are seen in FIGS. 3–5: a system which consists of a return sleeve 22 with openings for steel balls 23, which balls displace, after being pushed down from a return inner sleeve 24 from a return groove 25 in the inner surface of the outer barrel 1, to a groove 26 in the outer circumferential plane of the inner return sleeve 24. This return system is loaded by a return spring 27 and if the balls 23 arrive in a collector space 28 which is lower than the return groove 25, the return system will close the circulation ports again.

The opening of the circulation ports has been done in FIG. 4 by means of a hollow mandrel 29, a longitudinal section of which is illustrated in FIG. 5. It appears from FIG. 5 that the free passage for the mud is restricted as little as possible, that, however, a restriction is present as yet to be able to open the circulation ports with a ball again, and that at the location where the mandrel contacts the inner return sleeve a tapering portion is used, with ribs 31 thereon. Mandrels are usually not forced through the sleeves 9.

In case the bit is plugged the circulation ports have to be opened so that the mud can remain in the well and will not get lost when removing the drill string. Besides the mud has to remain in the well to prevent the escape of gas and to support the formation. But one cannot apply pressure to force a ball through the sleeve. In such a case it is still possible to open the sub, namely by dropping the heavy mandrel 29.

Also well control can always be re-established by using this mandrel.

In other cases than plugged bit this sub can of course be closed again.

The closing of the circulation ports in order to continue to drill again, is accomplished by increasing the pump strokes and thus raising the pressure. Forcing down the hard rubber ball (which has been pressed inside the lowering sleeve 24 on the throat 30 of the mandrel 29) will raise a sufficient pressure shock to unlock the sleeve whereafter the compression spring 27 will force the inner sleeve 9 back in a locked position.

A hard rubber ball will drop down on the screen 5 to prevent plugg of the bit nozzles (not shown).

In case another "lost circulation" problem occurs and it be required to open the special circulation sub again this should be done, especially if there is a gas zone in the part which has not yet been provided with a casing. Now a total loss of human lives and drilling plants can be prevented, as a cement plug can be placed without danger now.

Circulation sub with rotating port sleeve

FIGS. 6–9 relate to a sub with a rotating port sleeve 32 which, by interposing teflon rings 33, is placed on top of a fixed sleeve 34. For said sleeve 34 is fixed by at least two head screws 35, at a mutual angular distance of 90° and extending through the outer barrel. Through the sleeve 9 itself a head screw 36 protrudes as well and is in engagement with a helical groove 40 in the outer surface of the rotating port sleeve 32. This circulation sub itself comprises a set of steel balls 8 in a sleeve 9, an inner sleeve 11 having at its outer circumference a groove 12 to receive the balls and having at its inner circumference a groove for a retaining ring 21, and a helical spring 10, but the grooves 7 and 16 are not arranged in the outer barrel now as is the case in FIG. 1, but in the inner circumference of the fixed sleeve 34.

Underneath the above described system a compression spring 41 is arranged to close the circulation ports again, whereas in the inner circumferential plane of the fixed sleeve also a stop 42 is present to restrict the downward movement of the sleeve 9.

To open the rotating port-sleeve 32 a hard rubber or steel ball is used. The ball is dropped in the drill string and pumped-down. The ball will impinge on a wire formed retaining ring 21, causing a pressure increase and the sleeve 9 be unlocked unstantly by the impact force of the fluid compressing the spring 10 so that the balls enter into the groove 16. The fluid pressure or circulating pressure is now checked and should be considerable lower because the larger circulation areas compared to the combined area of the bit nozzles.

To close the circulation sub raise the number of pump strokes and lift the drill string several times over 10 to 20 meters. Then the drill string is lowered three to four meters, while braking at full force. If the circulation pressure is considerably higher after having done so, the circulation ports are closed. If this is not so, then a steel ball is thrown into the drill string, and it is pumped down with the normal pump-pressure until it is forced through the retaining ring and a short increase in pump pressure can be observed. After this the pump pressure will have to be constantly higher because everything is circulated through the drilling bit nozzles again. This sub can be opened and closed at least three to four times. One should take into account, however, that the port size and ball size are always different, in other words the used ball should always be larger than the port size.

The stop allows approximately 1 inch compression more, so that the balls of the locking system will lock in the lower groove 16 if the pump is stopped. Then the compression spring 41 will move the inner system upwardly, while the spring biased ball system rests in the lower groove.

Almost the whole system, except for the screen 5, is composed within the fixed sleeve 34, The rotating port sleeve 32 is placed above the fixed sleeve 34, after which the whole system can be slid within the outer barrel 1. The installation condition of the rotating port sleeve is the closed position. Before the two head screws 35 are provided, the central-point signs 43 in the center of the circulation ports 4 have to be checked.

It goes without saying that the rotating port sleeve 32 has a plurality of equally and mutually angularly spaced ports 44, preferably three, and only one of them is visible in FIGS. 7 and 8.

In the outer circumference plane of the port sleeve 32, exactly above and under the ports, grooves 45 are porvided which serve to receive the sealings 46 (FIG. 6).

What is claimed is:

1. A circulated sub comprising, (a) an outer barrel disposed between a drill string and a drill bit having a passage going therethrough along a longitudinal axis of said barrel, a plurality of circulation ports within said barrel;

(b) said passage adapted to receive a first sleeve along the longitudinal axis of said barrel (c) an inner second sleeve displacable along a longitudinal axis of said first sleeve, said inner first sleeve having a groove on its outer surface to receive a plurality of engaging members, said engaging members adapted to cooperate through an opening in said first sleeve with grooves on the inside surface of said barrel, a first spring means interposed between said inner first sleeve and said second sleeve in such manner that the axis of said spring means is coaxial to the longitudinal axis of said barrel; whereby during an operation of said sub said ports are closed by means of said first sleeve.

2. A sub according to claim 6 or 7, wherein the sleeve is provided with ports corresponding to the circulation ports, and that it is rotatable about the center line of the sub because a protrusion at the outer circumference of a forced rectilinearly moving driving sleeve is in engagement with a helical groove in the inner surface of the port sleeve.

3. A sub according to claim 1 wherein a return sleeve with a plurality of engaging members and second spring means are adapted to return the sleeve during the operation of the sub to a position when the ports are closed by the sleeve.

4. A sub according to claims 1 or 3 wherein at a lower end of the barrel a grid is provided to receive at least one ball which is used to open and close the ports.

5. A sub according to claims 1 or 3 wherein, said engaging members are a ball.

6. A sub according to claims 1 or 3 wherein, three circulation ports are provided within said barrel and said ports are symmetrically disposed at an angle 120° to each other.

* * * * *